United States Patent [19]

Collie

[11] 3,942,710

[45] Mar. 9, 1976

[54] FOLDING CARTON WITH INTERIOR STRUTS

[75] Inventor: Stafford D. Collie, Severna, Md.

[73] Assignee: Potlatch Corporation, San Francisco, Calif.

[22] Filed: Aug. 30, 1974

[21] Appl. No.: 502,015

[52] U.S. Cl. ..... 229/39 R; 229/15; 229/27; 229/29 C; 206/45.31; 206/45.14

[51] Int. Cl.[2] ..... B65J 5/50; B65J 5/10; B65J 5/48

[58] Field of Search.. 229/39 R, 39 B, 29 C, 28 BC, 229/15, 27, 28 R; 206/45.31, 45.14, 45.17

[56] References Cited

UNITED STATES PATENTS

| | | | |
|---|---|---|---|
| 1,654,140 | 12/1927 | Morris | 229/39 R |
| 2,611,529 | 9/1952 | Currivan | 229/39 B |
| 3,443,739 | 5/1969 | Adams, Jr. | 229/39 R |

FOREIGN PATENTS OR APPLICATIONS

| | | | |
|---|---|---|---|
| 568,486 | 6/1958 | Belgium | 229/39 B |

*Primary Examiner*—George E. Lowrance
*Assistant Examiner*—Douglas B. Farrow
*Attorney, Agent, or Firm*—Dominik, Knechtel, Godula & Demeur

[57] ABSTRACT

A folding carton is disclosed, preferably with a square cross-section when erected, having top and bottom forming members as well as front and rear and side members defining a square tube. Extending from one of the side members is a strut panel extending from one of the tubular forming panels, and having one extension strut and one reversely folded strut positioned thereon in spaced relationship. When the carton is erected, the two struts form a V-shaped type support, so that a triangular cross-section shaped bottle can be fitted within the carton, and secured against rotation. In the preferred embodiment, the front panel has an open window for displaying the label on the bottle. The bottom closure preferably is an automatic bottom, and positioned with the tug tabs adjacent the intersection of the strut panel and its adjacent panel so that when the carton is flattened, the two struts extend and are sandwiched in between the opposed pairs of panels.

16 Claims, 12 Drawing Figures

FIG. 1
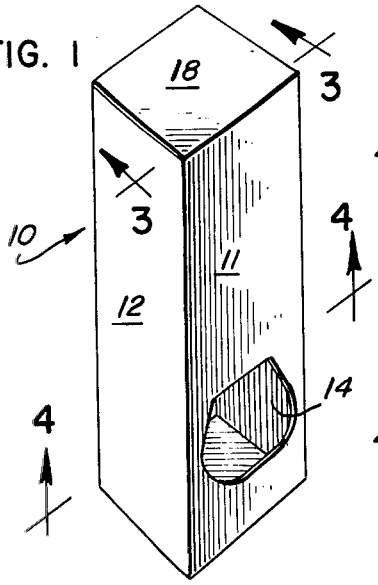
FIG. 3
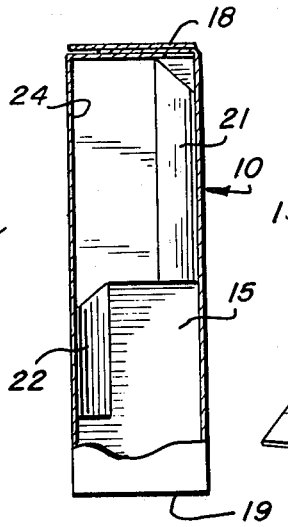
FIG. 2
PRIOR ART
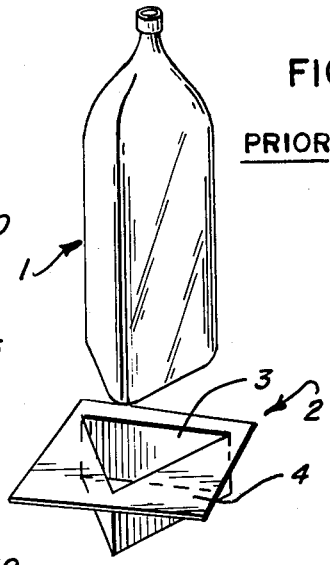
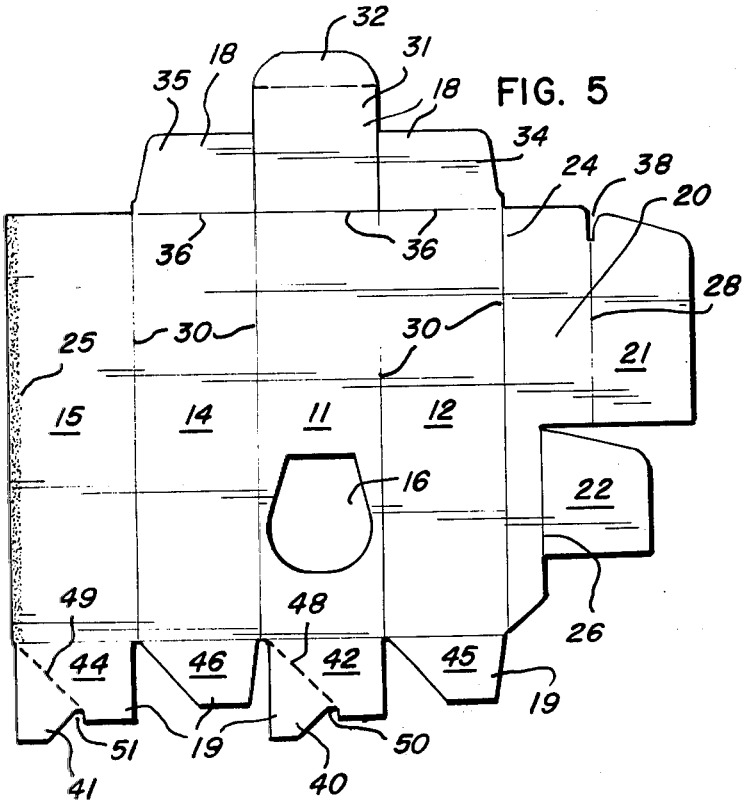
FIG. 5
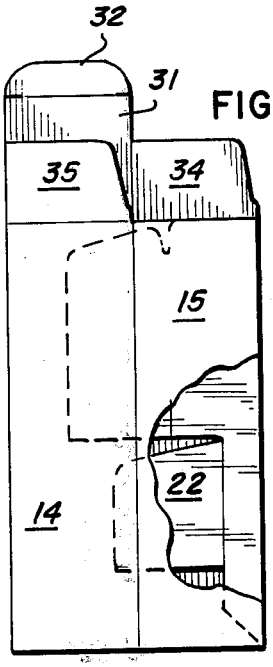
FIG. 6
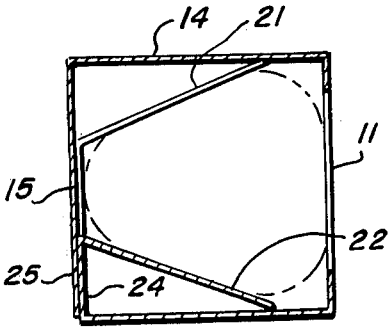
FIG. 4

FOLDING CARTON WITH INTERIOR STRUTS

BACKGROUND

1. Field of Invention

The subject carton relates generally to folding cartons having a rectangular cross-section and tubular body with top and bottom closures. More particularly, however, it relates to such a carton having an interior strut formation which is adaptable for securing non-rectangular elements in the carton, such as triangular cross-sectioned bottles. It will also assist in positioning bottles with more than three sides, just so long as the sides do not intersect at right angles.

2. Prior Art

The prior art, generally speaking, is taken from a wide variety of carton constructions which have separate inserts. An example of the prior art is shown in FIG. 2 of the accompanying drawings in which a triangular cross-section bottle 1 is positioned on a stand 2 having a triangular recess 3 and a rectangular flange 4; the rectangular flange 4 serving to secure the bottle 1 within the container or carton.

With the type of structure just described, it is quite obvious that there is a disadvantage in the manual or difficulty of automating the positioning of the stand within the carton. Furthermore, the separate stands must be shipped in nested form, or otherwise they become too bulky. In erecting the carton and in inserting bottles or other elements, where a separate stand is employed, it is a slower procedure and obviously more costly from the standpoint of filling the carton.

SUMMARY

The present invention is directed to a folding carton having an exterior rectangular cross-section for packaging a member, such as a bottle, having a non-rectangular cross-section, such as triangular. The carton has a front panel, side panels, and a rear panel which are joined in tubular form, and is further provided with a top and bottom permitting the carton to be shipped in a knocked down configuration. A strut panel extends from the side of one of the tubular forming panels, and has a reverse strut formed in the strut panel as well as an extension strut. The base of the strut panel is a glue flap portion, and is secured to the opposite panel when the carton is assembled. Thereafter, when the unit is erected, the reverse strut is reversely folded on itself, and the extension strut extends out until the ends of both intersect one of the panels. By viewing from the top, they (the struts) define a generally V-shaped support for nesting a triangular bottle, or a wider V can be utilized, if for example, the element for insertion is pentagonal or even hexagonal. Desirably the carton has an automatic bottom in which the tug tabs are positioned so that they crease adjacent the juncture of the glue flap and opposed panel and opposite that position. This insures a flat, extended, sandwiched relationship between the struts and the opposed pairs of panels in the knocked-down condition.

One of the principal objects of the present invention is to provide a folding carton which, upon erection, has its own independent self-contained support for a member having a non-rectangular, non-circular, cross-section.

Another object of the present invention is to provide a knocked-down carton with interior support struts which can be formed from a single sheet of carton forming material.

Still another object of the present invention is to provide a carton achieving the above objects in which the struts are extended and sandwiched between opposed pairs of panels because of the particular automatic bottom construction employed.

Still another object of the present invention, particularly when a triangular cross-section item is being contained, relates to positioning the struts in a window in a front panel so that one face of the triangular member can present advertising or other indicia through the window.

Still another advantage of the present invention, and a major objective, is a sturdy carton which is self-contained and which lends itself to inexpensive production.

DESCRIPTION OF ILLUSTRATIVE DRAWINGS

Further objects and advantages of the present invention will become apparent as the following description of the illustrative embodiment proceeds, taken in conjunction with the accompanying drawings in which:

FIG. 1 is a perspective view of an illustrative carton.

FIG. 2 is a partially exploded, partially diagrammatic view of the prior art type constructions showing a bottle having a triangular cross-section.

FIG. 3 is a front section taken along section line 3—3 of FIG. 1 showing the interior position of the struts in the illustrative carton.

FIG. 4 is a transverse sectional view taken along section line 4—4 of FIG. 1, showing, in phantom line, the bottle which is contained within the unit and how the struts engage the same for support.

FIG. 5 is a layout view of the die cut material from which the illustrative carton is formed.

FIG. 6 is a partially broken, partially diagrammatic view of the illustrative carton showing the general configuration of the struts in the knocked-down or folded condition.

DESCRIPTION OF PREFERRED EMBODIMENT

Figure 7:
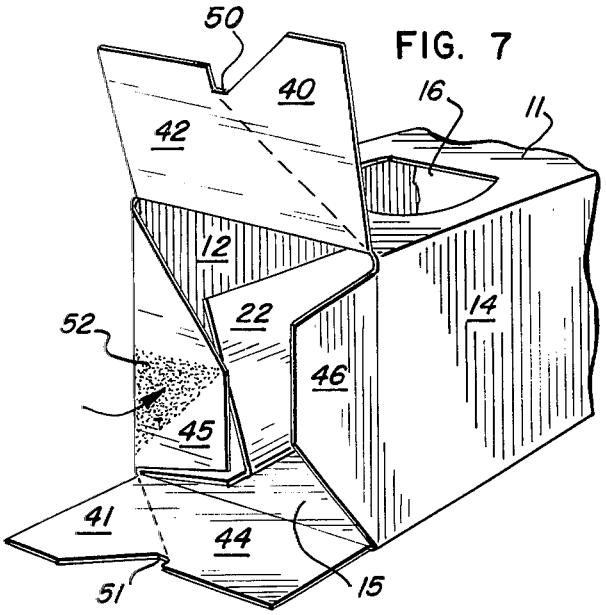
FIG. 7 is a partially diagrammatic, partially broken end view of the bottom portion of the carton illustrating the relationship of the elements of the bottom forming members.
Figure 8:
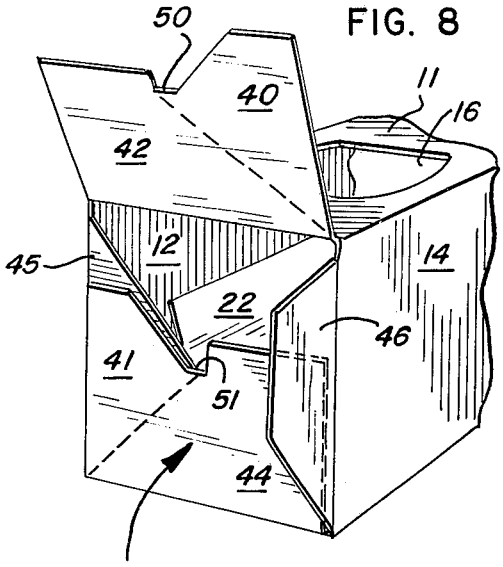
FIG. 8 is a sequential view from that shown in FIG. 7, illustrating how the bottom is assembled.

As pointed out above, an understanding of the invention and its advantages arises from a review of the typical prior art such as that shown in FIG. 2. There it will be seen that the bottle 1, having a generally isosceles triangular cross-sectional configuration is nested in a stand 2. Such a stand may be preformed from styrofoam, or molded from sheet plastic, in order to present a triangular recess 3 and an exterior flange portion 4. The stand 2 is then normally fitted into the lower portion of a folding carton, and the bottle 1 inserted into the recess 3, the same being retained against rotation by means of the recess 3 and the coaction of the edges of the flange 4 with the interior of the carton.

The present invention is directed, however, to the utilization of interior struts which form a generally V-shaped type support for a bottle 1, such as seen in FIG. 4. There it will be seen that the struts 21, 22, define a V-shape, and by engaging their respective panels, as well as the sides of the bottle 1, they serve the purpose of retaining the bottle 1 against rotation. In addition, a front panel 11 may be provided with a display hole 16, and the struts 21, 22, will direct the flat portion of the bottle against the display hole 16.

The typical exterior or the carton is shown in FIG. 1 where it will be seen that the carton 10 has a front panel 11 and side panels 12, 14, closed in the rear (not shown) by a back panel 15. One of the side panels is preferably a strut support side pannel, and the other a back support side panel. Top members 18 close one end of the carton 10, and bottom members 19 close the other end. Preferably the bottom members constitute those elements making up an automatic bottom, but the top may be of any particular configuration including those which are adaptable for decorative purposes such as receiving a bow, and the like.

All of the elements will be better understood in their respective relationship by a review of FIG. 5 in which the layout carton panel is shown. There it will be seen that the strut panel 20 includes an extension strut 21 and a reverse strut 22, the extension strut being above the reverse strut 22. Both struts are joined to the balance of the strut panel 20 by means of a strut score, a reverse strut score 26 being provided for the reverse strut 22, and another score 28 for the extension strut. The rear portion of the strut panel 20, where it joins the adjacent panel, namely side panel 12, is a glue flap portion and is glued to the glue portion 25 of the opposite panel, shown here as the back or rear panel 15.

The various panels are joined by panel scores 30. The top closure 31 has a cross-section substantially the same as the cross-section of the carton 10, and terminates with a top closure tab 32. Top flaps 34, 35 extend from the adjacent side panels 12, 14, and the top is closed by sequentially folding over the top flaps 34, 35, and thereafter bringing the top closure 31 into position with the top closure tab 32 tucked in against the flaps 34, 35, to close the top with the configuration as shown generally in FIG. 1. The top flaps are joined to their adjacent member by a top flap score 36, and the extension strut 21 is provided with a tab relief notch 38 so that the tab 32 of the top closure 31 will pass therethrough.

With the particular bottom construction to be described, the carton 10 closes in the configuration as shown in FIG. 6, with the struts 21, 22 extending in a flat sandwiched relationship between the opposed panels. In order to achieve this result, and easily when erecting or folding the carton, it is preferable to use an automatic bottom, and the automatic bottom should be in a particular relationship to the strut forming panel, namely, the scores 48, 49, in at least one case, must terminate at the point where the base of the strut panel 20 or its glue flap portion 24 adjoins the opposed panel, in this instance, the glue portion 25 of the rear panel 15. In the event the bottom members are moved from this orientation, the struts need to be reversed in order to fold the carton. It is more desirable to have the struts extended as shown in FIG. 6, since upon opening the carton, one can immediately insert the hand, or a fixture, to separate the struts to reversely fold the reverse strut 22 and extend the extension strut 21 to the configuration shown in FIG. 4, and thereafter insert the bottle 1 as shown in FIG. 4.

Figure 9:
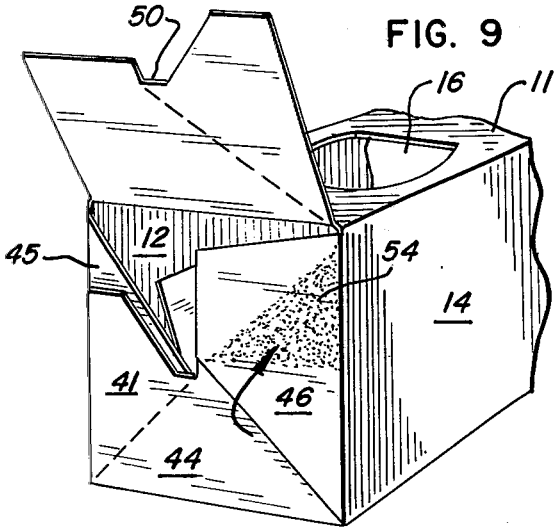
FIG. 9 is yet a further view of the carton shown in FIGS. 7 and 8 with a sequential assembly step being formed.
Figure 10:
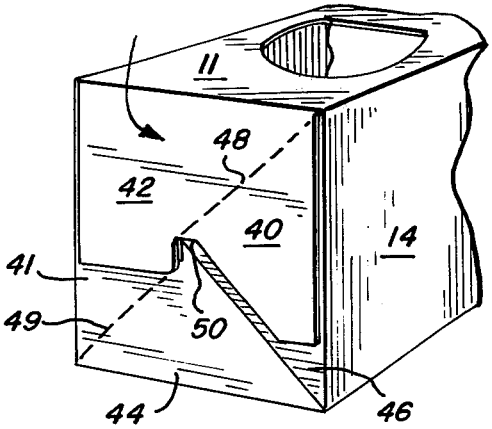
FIG. 10 is a sequential view of FIGS. 7, 8 and 9, illustrating the bottom in its fully formed configuration.

The bottom forming members as shown in FIG. 5, include a pair of opposed puller members 45, 46 which are secured beneath the side panels 12, 14. The bottom formers 42, 44, are respectively beneath the front panel 11 and rear or back panel 15, and by means of score lines 48, 49. The tub tabs 40, 41 are secured to the bottom formers, but conditioned for folding within the automatic bottom when the carton is in its flattened or knocked-down condition. The interlock notches 50, 51, are provided to lock the bottom construction in its erected configuration with sufficient strength to hold a bottle 1 or other such elements interiorly thereof. Glue spots 52, 54 are provided, as shown in FIGS. 7 and 9 respectively, to engage their opposed side puller elements 45, 46.

Figure 11:
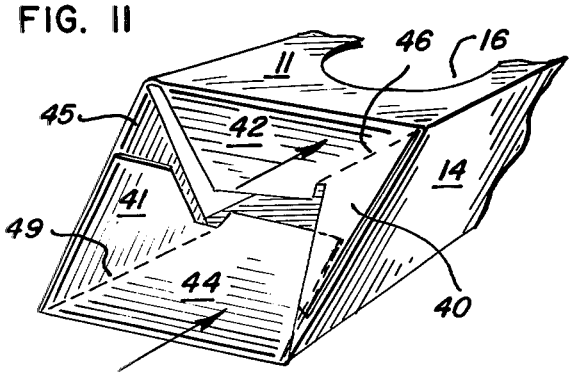
FIG. 11 is a further sequential view illustrating how the bottom retracts interiorly of the carton upon folding into the knocked-down configuration.
Figure 12:
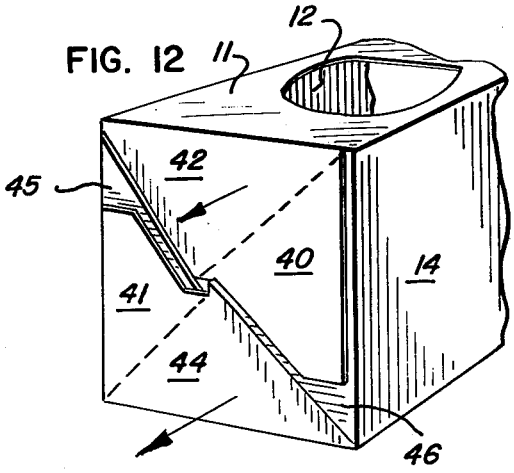
FIG. 12 is a final sequence in the bottom assembly illustrating how, when the carton is to be erected by biasing across its diagonal edges, the bottom is automatically formed.

As will be seen in FIGS. 7 through 12 inclusive, the bottom elements may be sequentially secured each to the other and in such a fashion, so that when the unit is pressed across its diagonal corners, such as shown in FIG. 11, the bottom elements fold inwardly within the carton, and yet pass the interior struts 21, 22. Alternatively, when the opposite corners are biased as shown in FIG. 12, the bottom members extend due to the pulling action of the tug tabs 40, 41, on the side pullers 45, 46.

In review it will be seen that the novel folding carton 10 has been disclosed and described which has an interior strut panel 20 having a pair of struts, one above the other, which respectively reversely fold and extend in order to define a V-shaped support for a triangular bottle 1. With the bottom formed in an advantageous sequence, the unit can be knocked down with the struts extended in sandwiched relationship between opposed pairs of panels as shown in FIG. 6. The entire carton, as amply illustrated in FIG. 5, is formed form a single sheet of material in an economical fashion.

Although particular embodiments of the invention have been shown and described in full here, there is no intention to thereby limit the invention to the details of such embodiments. On the contrary, the intention is to cover all modifications, alternatives, embodiments, usages and equivalents of a cabinet as fall within the spirit and scope of the invention, specification, and the appended claims.

What is claimed is:

1. A folding carton having an exterior rectangular cross section for packaging a member having a nonrectangular cross section comprising, in combination, a front panel, side panels, and a rear panel, a strut panel extending from one of said panels, an extension strut formed in said strut panel and having an extension strut score, a reverse strut formed in said strut panel and having a reverse strut score parallel to and spaced from the extension strut score, a glue flap portion adjacent the junction of the strut panel and the panel from which it extends, said extension and reverse struts being above and below each other, said glue flap portion being secured to the marginal edge of the panel remote from the strut panel to form a tubular folding carton with front, side and rear panels, top closure means extending from the upper portion of ones of said panels, bottom forming means extending from the lower portion of said panels and secured to each other to form a bottom when the carton is erected, said extension and reverse strut being formed to extend from and reversely fold from said strut panel when the carton is erected to have an angular relationship each with the other and having their ends contact ones of said panels, whereby an interior nest is provided by the struts in the carton when erected to receive a non-rectangular cross sectioned member and nestingly engage the same against rotation.

2. In the carton of claim 1, said strut panel extending from a side panel, and said glue flap portion being secured to the marginal edge of the rear panel.

3. In the carton of claim 1, said front panel having a window, said struts extending centrally on the rear panel, whereby a member with faces defining a substantially isosceles cross section will present one face to the window and two other faces will engage the struts.

4. In the carton of claim 1, said top comprising a top closure having a tab and extending from the front panel, top side flaps extending from the side panels, whereby smooth edges are presented at the top of the front and side panels when closed.

5. In the carton of claim 2, said front panel having a window, said struts extending centrally on the rear panel, whereby a member with faces defining a substantially isosceles cross section will present one face to the window and two other faces will engage the struts.

6. In the carton of claim 1, said bottom comprising opposed pullers extending from opposed panels, and opposed bottom formers extending from the other opposed panels, said opposed bottom formers having tug tab portions secured to the adjacent pullers, whereby biasing a diagonal of the folded carton will form the bottom.

7. In the carton of claim 2, said bottom comprising opposed pullers extending from opposed panels, and opposed bottom formers extending from the other opposed panels, said opposed bottom formers having tug tab portions secured to the adjacent pullers, whereby biasing a diagonal of the folded carton will form the bottom.

8. In the carton of claim 7, said pullers extending from the lower portion of said front and rear panels, thereby directing the struts toward the front panel when closed and divergingly toward the rear panel when the carton is erected.

9. In the carton of claim 7, said front panel having a window, said struts extending centrally on the rear panel, whereby a member with faces defining a substantially isosceles cross section will present one face to the window and two other faces will engage the struts.

10. In the carton of claim 3, said strut panel extending from a side panel, and said glue flap portion being secured to the marginal edge of the rear panel.

11. In the carton of claim 8, said front panel having a window, said struts extending centrally on the rear panel, whereby a member with faces defining a substantially isosceles cross section will present one face to the window and two other faces will engage the struts.

12. In the carton of claim 6, each of said tug tabs having an edge terminating substantially at an intersection of two panels, one of said edges terminating substantially at the intersection of the strut panel and its adjacent panel, whereby upon flattening the carton the struts will both extend between the opposed pairs of folded panels.

13. In the carton of claim 6, said tug tabs being part of a bottom former with a diagonal score line for folding, the base of said score line terminating at the intersection of a panel and the base of the strut panel.

14. In the carton of claim 12, said tug tabs being part of a bottom former with a diagonal score line for folding, the base of said score line terminatng at the intersection of a panel and the base of the strut panel.

15. In the carton of claim 1, said extension strut having a tab relief notch formed at the upper portion of the extension strut score, whereby the top closure means can extend into the notch for closing.

16. In the carton of claim 4, said extension strut having a tab relief notch formed at the upper portion of the extension strut, whereby the top closure tab may be inserted into the notch.

* * * * *